US010923044B2

(12) United States Patent
Koo et al.

(10) Patent No.: US 10,923,044 B2
(45) Date of Patent: Feb. 16, 2021

(54) METHOD OF ADJUSTING LUMINANCE OF A BACKLIGHT UNIT INCLUDED IN A LIQUID CRYSTAL DISPLAY DEVICE

(71) Applicant: Samsung Display Co., Ltd., Yongin-si (KR)

(72) Inventors: Jahun Koo, Asan-si (KR); Su-Han Woo, Asan-si (KR); Kyung-Hun Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/657,408

(22) Filed: Oct. 18, 2019

(65) Prior Publication Data

US 2020/0175930 A1 Jun. 4, 2020

(30) Foreign Application Priority Data

Dec. 3, 2018 (KR) ..... 10-2018-0153251

(51) Int. Cl.
*G09G 3/34* (2006.01)
*G09G 3/36* (2006.01)

(52) U.S. Cl.
CPC ..... *G09G 3/3406* (2013.01); *G09G 3/3614* (2013.01); *G09G 2320/0247* (2013.01); *G09G 2360/16* (2013.01)

(58) Field of Classification Search
CPC ..... G09G 2320/0247; G09G 2360/16; G09G 3/3406; G09G 3/3614; G09G 3/2003; G09G 3/36; G09G 3/2081; G06T 5/40
See application file for complete search history.

(56) References Cited

U.S. PATENT DOCUMENTS

2009/0289968 A1* 11/2009 Yoshida ..... G09G 3/2081 345/691
2010/0214478 A1* 8/2010 Miyazawa ..... G06T 5/40 348/553
2013/0249880 A1* 9/2013 Chen ..... G09G 3/36 345/211
2016/0027363 A1* 1/2016 Lee ..... G09G 3/2003 345/691

FOREIGN PATENT DOCUMENTS

KR 10-1126499 B1 3/2012
KR 10-1397010 B1 5/2014
KR 10-2016-0084035 A 7/2016
KR 10-1675840 B1 11/2016
KR 10-2018-0078590 A 7/2018

* cited by examiner

*Primary Examiner* — Richard J Hong
(74) *Attorney, Agent, or Firm* — Lewis Roca Rothgerber Christie LLP

(57) ABSTRACT

A method of adjusting luminance of a backlight unit included in a liquid crystal display device that performs inversion driving is provided. The method derives a positive polarity histogram and a negative polarity histogram of an image frame based on image frame data, corresponding to the image frame, and a data polarity pattern for implementing the image frame, derives a luminance compensation value according to data polarity dominance of the image frame by analyzing the positive polarity histogram and the negative polarity histogram, and applies the luminance compensation value to the luminance of the backlight unit during a portion of a time period of the image frame.

20 Claims, 10 Drawing Sheets

METHOD OF ADJUSTING LUMINANCE OF A BACKLIGHT UNIT INCLUDED IN A LIQUID CRYSTAL DISPLAY DEVICE

CROSS-REFERENCE TO RELATED APPLICATION

This application claims priority to and the benefit of Korean Patent Application No. 10-2018-0153251, filed on Dec. 3, 2018 in the Korean Intellectual Property Office (KIPO), the content of which is incorporated herein in its entirety by reference.

BACKGROUND

1. Field

Example embodiments relate generally to a liquid crystal display device. More particularly, embodiments of the present inventive concept relate to a method of adjusting luminance of a backlight unit included in a liquid crystal display device that, e.g., performs an inversion driving method.

2. Description of the Related Art

Generally, a liquid crystal display device performs an inversion driving method (e.g., a dot-inversion manner, a line-inversion manner, a column-inversion manner, a frame-inversion manner, a Z-inversion manner, an active level shift (ALS)-inversion manner, etc) that repeatedly inverts data polarity for consecutive image frames to have different data polarity patterns in order to reduce or prevent deterioration of a liquid crystal structure included in the liquid crystal display device. Here, because transmittance of the liquid crystal structure due to positive polarity data is different from transmittance of the liquid crystal structure due to negative polarity data, a flicker that a viewer (or user) can perceive may occur from among consecutive image frames when data polarity dominance of the image frame is severe (i.e., when positive polarity data is dominant based on gray levels or when negative polarity data is dominant based on gray levels). Thus, when a current image frame has a reference pattern not suited for a first inversion manner, a related art method may reduce or prevent the flicker by controlling a liquid crystal display device to perform an inversion driving method in a second inversion manner for a next image frame while the liquid crystal display device performs the inversion driving method in the first inversion manner for the current image frame. However, because the related art method applies an analysis result of the current image frame to the next image frame, the related art method may aggravate the flicker when a pattern difference between the current image frame and the next image frame is large. In addition, it may be impossible for the related art method to set all reference patterns by which the flicker can occur. Furthermore, because a driving frequency of the liquid crystal display device cannot be obtained only by analyzing the current image frame, the related art method may not reduce or prevent a low frequency flicker that occurs when the liquid crystal display device operates at a low driving frequency.

SUMMARY

Aspects of some example embodiments are directed toward a method of adjusting luminance of a backlight unit that can reduce or prevent a flicker that a viewer may perceive from among consecutive image frames by reflecting data polarity dominance of the image frame to adjust the luminance of the backlight unit when the data polarity dominance of the image frame is severe (i.e., when positive polarity data is dominant based on gray levels or when negative polarity data is dominant based on gray levels), where the backlight unit is included in a liquid crystal display device that performs an inversion driving method that repeatedly inverts data polarity for consecutive image frames to have different data polarity patterns in order to reduce or prevent deterioration of a liquid crystal structure included in the liquid crystal display device.

According to example embodiments, a method of adjusting luminance of a backlight unit included in a liquid crystal display device that performs inversion driving may include an operation of deriving a positive polarity histogram and a negative polarity histogram of an image frame based on image frame data, corresponding to the image frame, and a data polarity pattern for implementing the image frame, an operation of deriving a luminance compensation value according to data polarity dominance of the image frame by analyzing the positive polarity histogram and the negative polarity histogram, and an operation of applying the luminance compensation value to the luminance of the backlight unit during a portion of a time period of the image frame.

In example embodiments, the portion of the time period of the image frame may substantially begin at a start point of a blank period of the image frame and substantially end at an end point of the blank period of the image frame.

In example embodiments, the portion of the time period of the image frame may substantially begin at a first point which is after a start point of a blank period of the image frame and substantially end at an end point of the blank period of the image frame.

In example embodiments, the portion of the time period of the image frame may substantially begin at a start point of a blank period of the image frame and substantially end at a second point which is before an end point of the blank period of the image frame.

In example embodiments, the portion of the time period of the image frame may substantially begin at a first point which is after a start point of a blank period of the image frame and substantially end at a second point which is before an end point of the blank period of the image frame.

In example embodiments, a weighted value may be applied to the luminance compensation value differently for respective locations of a display panel included in the liquid crystal display device.

In example embodiments, the luminance compensation value according to the data polarity dominance may be derived by searching a preset mapping table.

In example embodiments, the data polarity dominance may be determined by comparing a sum of gray levels of positive polarity data with a sum of gray levels of negative polarity data.

According to example embodiments, a method of adjusting luminance of a backlight unit included in a liquid crystal display device that performs inversion driving may include an operation of deriving a positive polarity histogram and a negative polarity histogram of an image frame based on image frame data, corresponding to the image frame, and a data polarity pattern for implementing the image frame, an operation of deriving a luminance compensation value according to data polarity dominance of the image frame by analyzing the positive polarity histogram and the negative polarity histogram, an operation of applying the luminance compensation value to the luminance of the backlight unit from a start point of a blank period of the image frame to an end point of the blank period of the image frame, an operation of measuring an elapsed time from the start point of the blank period of the image frame, and an operation of applying first through (N)th additional luminance compensation values, where N is an integer greater than or equal to 1, to the luminance of the backlight unit, sequentially as the elapsed time reaches corresponding first through (N)th reference times.

In example embodiments, the elapsed time may be measured by counting data enable clocks or oscillator reference clocks.

In example embodiments, a weighted value may be applied to the luminance compensation value and the first through (N)th additional luminance compensation values differently for respective locations of a display panel included in the liquid crystal display device.

In example embodiments, the luminance compensation value according to the data polarity dominance may be derived by searching a preset mapping table.

In example embodiments, the data polarity dominance may be determined by comparing a sum of gray levels of positive polarity data with a sum of gray levels of negative polarity data.

According to still another example embodiments, a method of adjusting luminance of a backlight unit included in a liquid crystal display device that performs inversion driving may include an operation of deriving a positive polarity histogram and a negative polarity histogram of an image frame based on image frame data, corresponding to the image frame, and a data polarity pattern for implementing the image frame, an operation of deriving a luminance compensation value according to data polarity dominance of the image frame by analyzing the positive polarity histogram and the negative polarity histogram, and an operation of applying the luminance compensation value to the luminance of the backlight unit during a portion of a time period of the image frame and a portion of a time period of a next image frame following the image frame.

In example embodiments, the portion of the time period of the image frame may substantially begin at a start point of a blank period of the image frame and substantially end at an end point of the blank period of the image frame.

In example embodiments, the portion of the time period of the image frame may substantially begin at a first point which is after a start point of a blank period of the image frame and substantially end at an end point of the blank period of the image frame.

In example embodiments, the portion of the time period of the next image frame may substantially begin at a start point of an active period of the next image frame and substantially end at a second point which is before an end point of the active period of the next image frame.

In example embodiments, a weighted value may be applied to the luminance compensation value differently for respective locations of a display panel included in the liquid crystal display device.

In example embodiments, the luminance compensation value according to the data polarity dominance may be derived by searching a preset mapping table.

In example embodiments, the data polarity dominance may be determined by comparing a sum of gray levels of positive polarity data with a sum of gray levels of negative polarity data.

Therefore, a method of adjusting luminance of a backlight unit, which is included in a liquid crystal display device that performs an inversion driving method that repeatedly inverts data polarity for consecutive image frames to have different data polarity patterns in order to reduce or prevent deterioration of a liquid crystal structure included in the liquid crystal display device, according to example embodiments, may derive a positive polarity histogram and a negative polarity histogram of an image frame based on image frame data, corresponding to the image frame, and a data polarity pattern for implementing the image frame, may derive a luminance compensation value according to data polarity dominance of the image frame by analyzing the positive polarity histogram and the negative polarity histogram of the image frame, and may reflect the luminance compensation value according to the data polarity dominance of the image frame on the luminance of the backlight unit during a portion of a time period of the image frame (or during a portion of a time period of the image frame and a portion of a time period of a next image frame following the image frame). Thus, the method of adjusting the luminance of the backlight unit may reduce or prevent a flicker that a viewer may perceive from among consecutive image frames when the data polarity dominance of the image frame is severe (i.e., when positive polarity data is dominant based on gray levels or when negative polarity data is dominant based on gray levels). In addition, the method of adjusting the luminance of the backlight unit may reduce or prevent a low frequency flicker that occurs when the liquid crystal display device operates at a low driving frequency by measuring an elapsed time from the start point of the blank period of the image frame and by reflecting the first through (N)th additional luminance compensation values on the luminance of the backlight unit, respectively (sequentially) as the elapsed time reaches the first through (N)th reference times (the corresponding first through (N)th reference times), respectively.

BRIEF DESCRIPTION OF THE DRAWINGS

Illustrative, non-limiting example embodiments will be more clearly understood from the following detailed description in conjunction with the accompanying drawings.

DETAILED DESCRIPTION

Hereinafter, embodiments of the present inventive concept will be explained in more detail with reference to the accompanying drawings.

Figure 1:
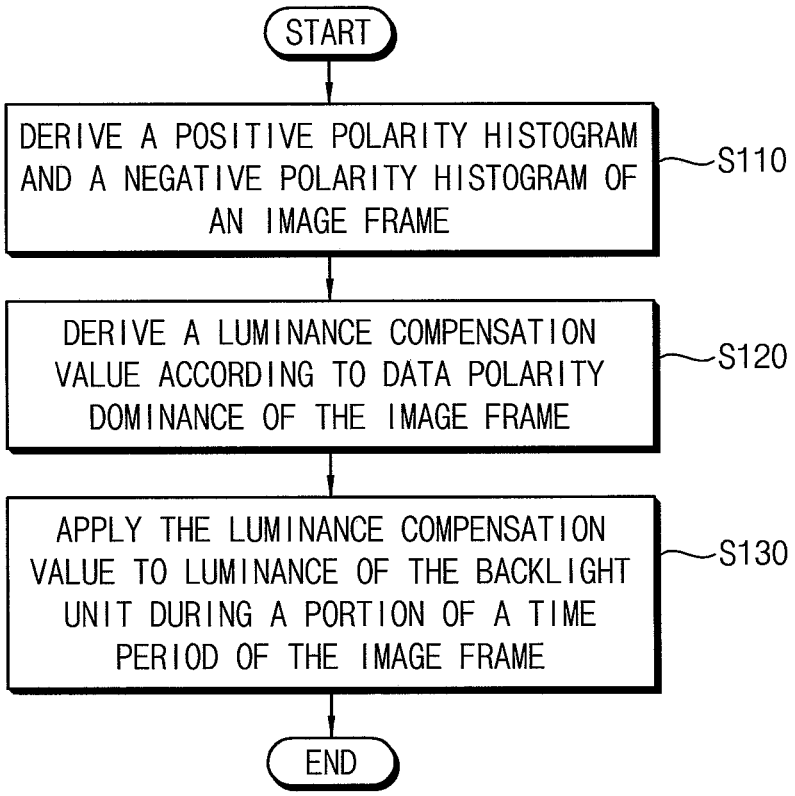
FIG. 1 is a flowchart illustrating a method of adjusting luminance of a backlight unit according to example embodiments.
Figure 2:
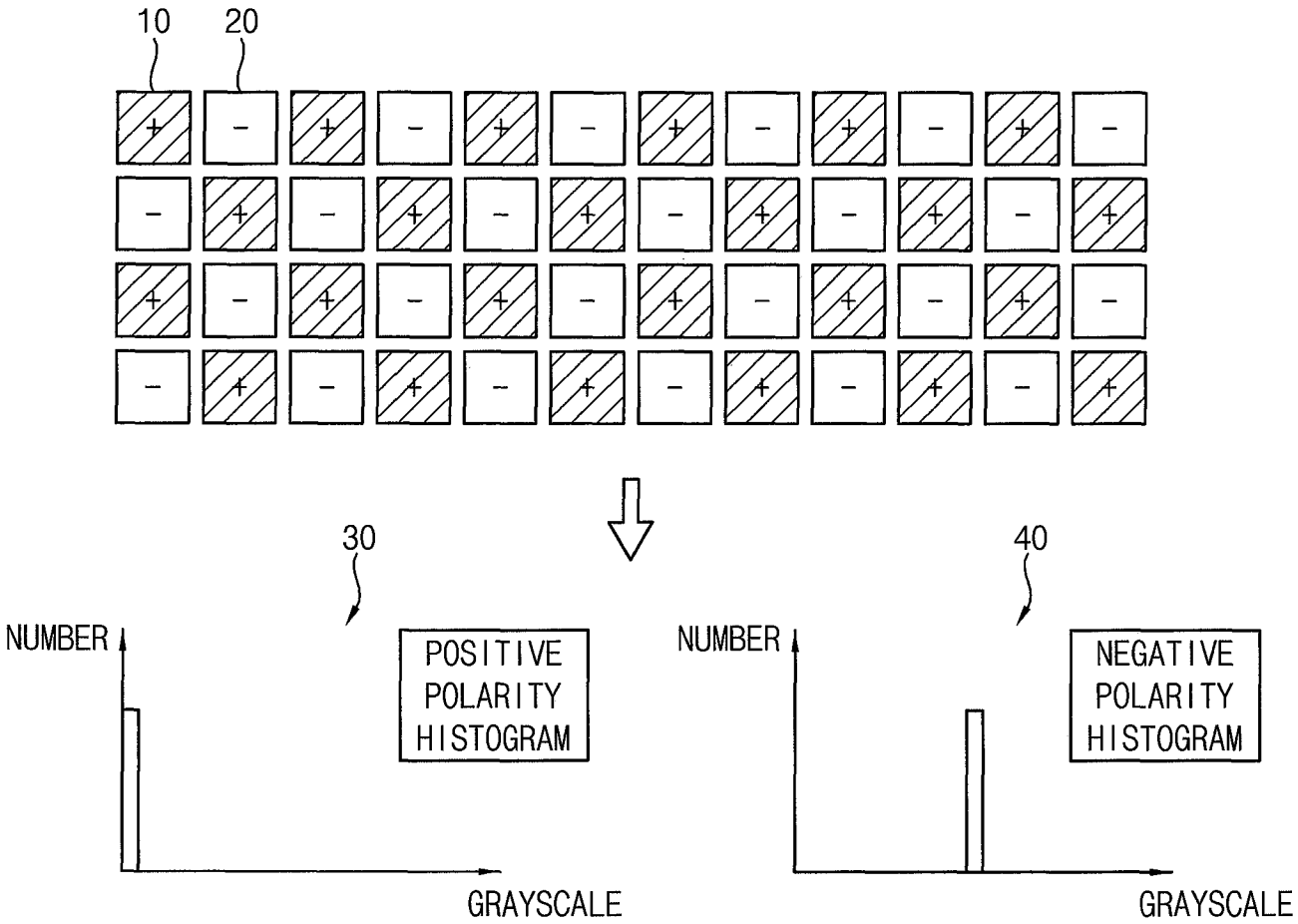
FIG. 2 is a diagram illustrating an example in which the method of FIG. 1 derives a positive polarity histogram and a negative polarity histogram.

FIG. 1 is a flowchart illustrating a method of adjusting luminance of a backlight unit according to example embodiments, FIG. 2 is a diagram illustrating an example in which the method of FIG. 1 derives a positive polarity histogram and a negative polarity histogram, and FIGS. 3A-3D are diagrams illustrating examples in which the method of FIG. 1 reflects a luminance compensation value on luminance of a backlight unit.

Referring to FIGS. 1-3D, the method of FIG. 1 may adjust the luminance of the backlight unit included in the liquid crystal display device that performs an inversion driving method that repeatedly inverts data polarity for consecutive image frames IF(n) and IF(n+1) to have different data polarity patterns in order to reduce or prevent deterioration of a liquid crystal structure included in the liquid crystal display device. Here, the method of FIG. 1 may derive a positive polarity histogram 30 and a negative polarity histogram 40 of the image frame IF(n) based on image frame data, corresponding to the image frame IF(n), and a data polarity pattern (indicated by + and −) for implementing the image frame IF(n) (S110). The method of FIG. 1 may derive a luminance compensation value according to data polarity dominance of the image frame IF(n) by analyzing the positive polarity histogram 30 and the negative polarity histogram 40 of the image frame IF(n) (S120). The method of FIG. 1 may also reflect the luminance compensation value according to the data polarity dominance of the image frame IF(n) on the luminance of the backlight unit during a portion of a time period of the image frame IF(n) (S130).

Specifically, the method of FIG. 1 may derive the positive polarity histogram 30 and the negative polarity histogram 40 of the image frame IF(n) based on the image frame data, corresponding to the image frame IF(n), and the data polarity pattern + and − for implementing the image frame IF(n) (S110). For example, as illustrated in FIG. 2, when the data polarity pattern (indicated by + and −) for implementing the image frame IF(n) may be a dot pattern in which positive polarity data (indicated by +) and negative polarity data (indicated by −) are alternated and when the image frame data includes high-gray level data (indicated by bright boxes) and low-gray level data (indicated by dark boxes) that are alternated as the dot pattern, the positive polarity data may be mostly the low-gray level data and the negative polarity data may be mostly the high-gray level data. In this case, the positive polarity histogram 30 may have a skewed shape toward a relatively low-gray level region and the negative polarity histogram 40 may have a skewed shape toward a relatively high-gray level region. Thus, the method of FIG. 1 may derive (or obtain) the data polarity dominance of the image frame IF(n) (i.e., determine which is dominant based on gray levels between the positive polarity data and the negative polarity data) by analyzing the positive polarity histogram 30 and the negative polarity histogram 40 of the image frame IF(n).

Next, the method of FIG. 1 may derive the luminance compensation value according to the data polarity dominance of the image frame IF(n) by analyzing the positive polarity histogram 30 and the negative polarity histogram 40 of the image frame IF(n) (S120). Here, the data polarity dominance of the image frame IF(n) may be determined by comparing a sum of gray levels of the positive polarity data with a sum of gray levels of the negative polarity data. However, determining the data polarity dominance of the image frame IF(n) is not limited thereto. In an example embodiment, the luminance compensation value according to the data polarity dominance of the image frame IF(n) may be derived by searching a preset mapping table. For example, the mapping table may include candidate data polarity dominances and candidate luminance compensation values matched with the candidate data polarity dominances. Thus, the method of FIG. 1 may derive (or obtain) the data polarity dominance of the image frame IF(n) by analyzing the positive polarity histogram 30 and the negative polarity histogram 40 of the image frame IF(n), may search for a candidate data polarity dominance that is consistent with the data polarity dominance of the image frame IF(n), may search for a candidate luminance compensation value matched with the candidate data polarity dominance in the mapping table, and may determine the candidate luminance compensation value as the luminance compensation value according to the data polarity dominance of the image frame IF(n).

In example embodiments, the luminance that the viewer perceives may be relatively high when the positive polarity data is dominant based on gray levels in the image frame IF(n), and the luminance that the viewer perceives may be relatively low when the negative polarity data is dominant based on gray levels in the image frame IF(n). In this case, the method of FIG. 1 may determine (or set) the luminance compensation value according to the data polarity dominance of the image frame IF(n) to decrease the luminance of the backlight unit when the positive polarity data is dominant based on gray levels in the image frame IF(n). On the other hand, the method of FIG. 1 may determine the luminance compensation value according to the data polarity dominance of the image frame IF(n) to increase the luminance of the backlight unit when the negative polarity data is dominant based on gray levels in the image frame IF(n). In example embodiments, the luminance that the viewer perceives may be relatively low when the positive polarity data is dominant based on gray levels in the image frame IF(n), and the luminance that the viewer perceives may be relatively high when the negative polarity data is dominant based on gray levels in the image frame IF(n). In this case, the method of FIG. 1 may determine (or set) the luminance compensation value according to the data polarity dominance of the image frame IF(n) to increase the luminance of the backlight unit when the positive polarity data is dominant based on gray levels in the image frame IF(n). On the other hand, the method of FIG. 1 may determine the luminance compensation value according to the data polarity dominance of the image frame IF(n) to decrease the luminance of the backlight unit when the negative polarity data is dominant based on gray levels in the image frame IF(n).

In example embodiments, when the method of FIG. 1 determines the luminance compensation value according to the data polarity dominance of the image frame IF(n), the method of FIG. 1 may apply a weighted value differently to the luminance compensation value according to the data polarity dominance of the image frame IF(n) for respective locations of a display panel included in the liquid crystal display device. For example, in a structure (e.g., referred to as a direct LED BLU structure) in which the display panel included in the liquid crystal display device is divided into first through (k)th display regions, where k is an integer greater than or equal to 2, the backlight unit may be disposed under the display panel, and the backlight unit may include first through (k)th light emitting elements (e.g., light emitting diode LED) at corresponding locations of the first through (k)th display regions of the display panel. The method of FIG. 1 may set the luminance compensation value differently according to the data polarity dominance of the image frame IF(n) for respective locations of the display panel. Thus, when luminance of a peripheral region of the display panel is lower than luminance of a central region of the display panel due to characteristics of the display panel, the method of FIG. 1 may set the luminance compensation value according to the data polarity dominance of the image frame IF(n) by applying different weighted values to respective locations of the display panel in order to compensate for the luminance of the peripheral region of the display panel more as compared to the luminance of the central region of the display panel. On the other hand, when the luminance of the peripheral region of the display panel is higher than the luminance of the central region of the display panel due to characteristics of the display panel, the method of FIG. 1 may set the luminance compensation value according to the data polarity dominance of the image frame IF(n) by applying different weighted values to respective locations of the display panel in order to compensate for the luminance of the peripheral region of the display panel less as compared to the central region of the display panel. Because these are examples, it should be understood that the luminance compensation value according to the data polarity dominance of the image frame IF(n) can be set differently for respective locations of the display panel.

Figure 3A:
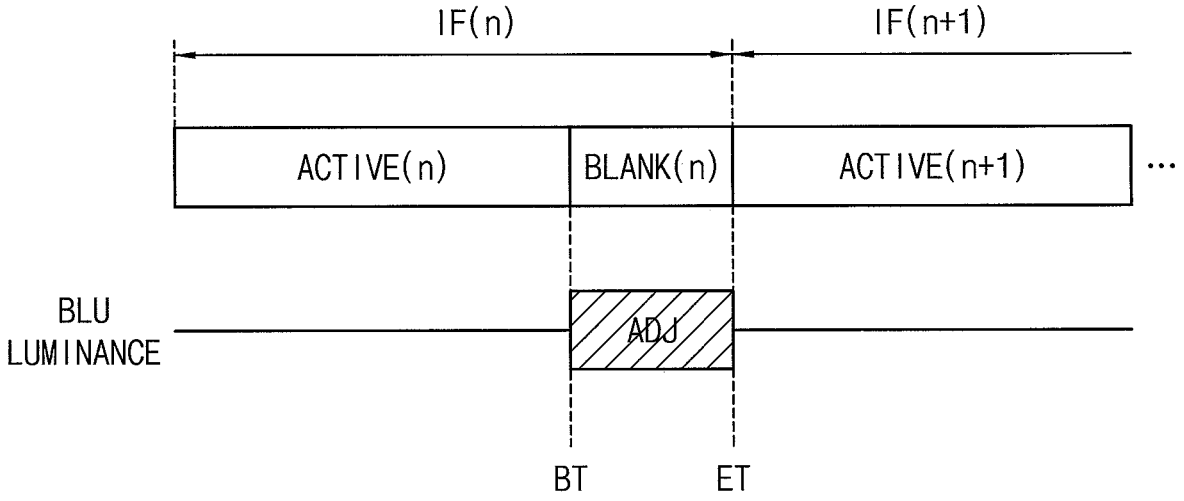
FIGS. 3A-3D are diagrams illustrating examples in which the method of FIG. 1 reflects a luminance compensation value on luminance of a backlight unit.
Figure 3B:
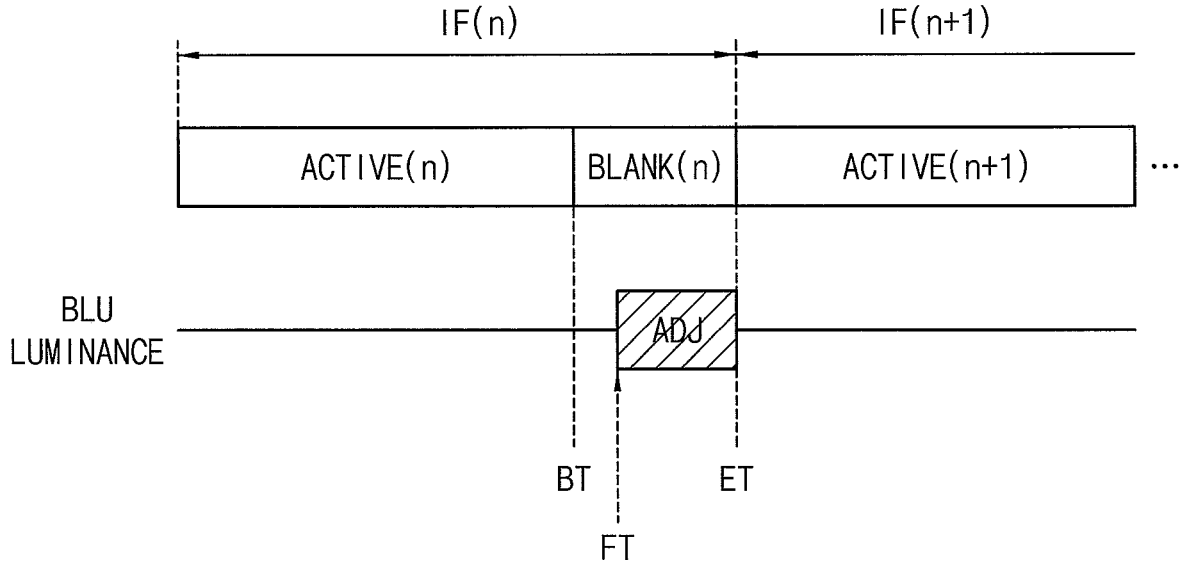
Figure 3C:
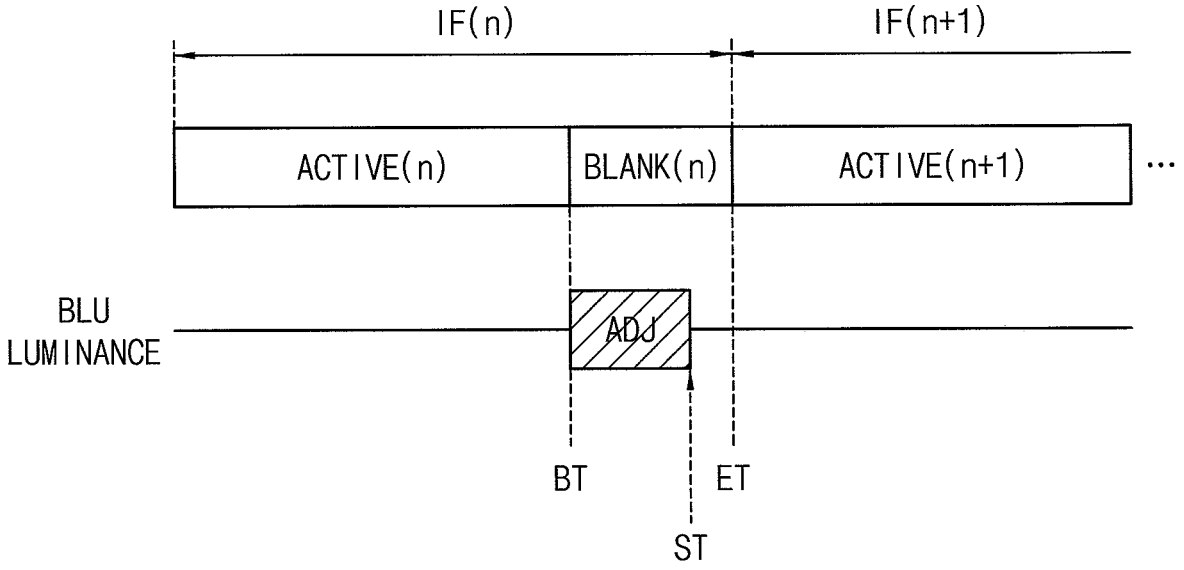
Figure 3D:
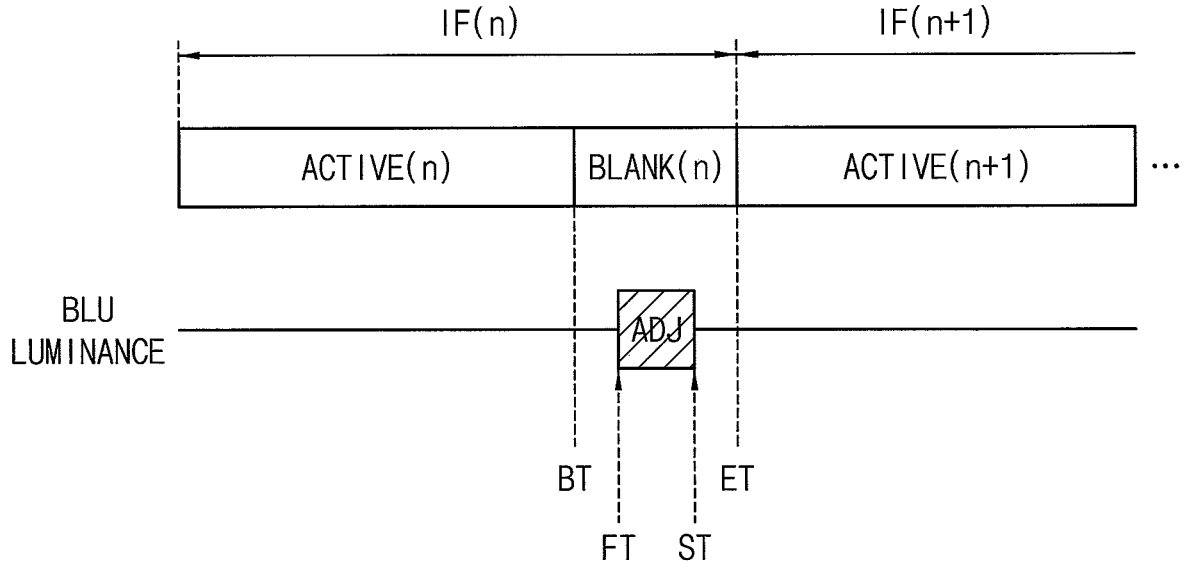

Subsequently, the method of FIG. 1 may reflect (apply) the luminance compensation value according to the data polarity dominance of the image frame IF(n) on (to) the luminance of the backlight unit during the portion of the time period of the image frame IF(n) (S130). In other words, except for the portion of the time period of the image frame IF(n), the method of FIG. 1 may maintain the luminance of the backlight unit as it is (e.g., without reflecting the luminance compensation value on the backlight unit) during the time period of the image frame IF(n). During the portion of the time period of the image frame IF(n), the method of FIG. 1 may adjust the luminance of the backlight unit. In an example embodiment, as illustrated in FIG. 3A, the method of FIG. 1 may reflect the luminance compensation value according to the data polarity dominance of the image frame IF(n) on the luminance of the backlight unit from a start point BT of a blank period BLANK(n) of the image frame IF(n) to an end point ET of the blank period BLANK(n) of the image frame IF(n) (indicated by ADJ). In another example embodiment, as illustrated in FIG. 3B, the method of FIG. 1 may reflect the luminance compensation value according to the data polarity dominance of the image frame IF(n) on the luminance of the backlight unit from a first point FT that is after the start point BT of the blank period BLANK(n) of the image frame IF(n) to the end point ET of the blank period BLANK(n) of the image frame IF(n) (indicated by ADJ). In still another example embodiment, as illustrated in FIG. 3C, the method of FIG. 1 may reflect the luminance compensation value according to the data polarity dominance of the image frame IF(n) on the luminance of the backlight unit from the start point BT of the blank period BLANK(n) of the image frame IF(n) to a second point ST that is before the end point ET of the blank period BLANK (n) of the image frame IF(n) (indicated by ADJ). In still another example embodiment, as illustrated in FIG. 3D, the method of FIG. 1 may reflect the luminance compensation value according to the data polarity dominance of the image frame IF(n) on the luminance of the backlight unit from the first point FT that is after the start point BT of the blank period BLANK(n) of the image frame IF(n) to the second point ST that is before the end point ET of the blank period BLANK(n) of the image frame IF(n) (indicated by ADJ).

As described above, the method of FIG. 1 may adjust the luminance of the backlight unit included in the liquid crystal display device that performs the inversion driving method that repeatedly inverts the data polarity for consecutive image frames IF(n) and IF(n+1) to have different data polarity patterns in order to reduce or prevent the deterioration of the liquid crystal structure. Here, the method of FIG. 1 may reduce or prevent the flicker that the viewer may perceive from among consecutive image frames IF(n) and IF(n+1) when the data polarity dominance of the image frame IF(n) is severe (i.e., when the positive polarity data is dominant based on gray levels or when the negative polarity data is dominant based on gray levels) by deriving the positive polarity histogram 30 and the negative polarity histogram 40 of the image frame IF(n) based on the image frame data, corresponding to the image frame IF(n), and the data polarity pattern (indicated by + and −) for implementing the image frame IF(n) (S110), by deriving the luminance compensation value according to the data polarity dominance of the image frame IF(n) by analyzing the positive polarity histogram 30 and the negative polarity histogram 40 of the image frame IF(n) (S120), and by reflecting the luminance compensation value according to the data polarity dominance of the image frame IF(n) on the luminance of the backlight unit during the portion of the time period of the image frame IF(n) (S130). Although the acts S110, S120, and S130 are described with respect to the image frame IF(n), the acts S110, S120, and S130 may be performed in the same manner for the next image frame IF(n+1). However, because the data polarity pattern of the image frame IF(n) is different from that of the next image frame IF(n+1) as the liquid crystal display device performs the inversion driving method, the luminance compensation value according the data polarity dominance of the image frame IF(n) may be different from that of the next image frame IF(n+1) even when the same image frame data is applied for the image frame IF(n) and the next image frame IF(n+1). Furthermore, because the method of FIG. 1 applies an analysis result of the image frame IF(n) to the image frame IF(n), the method of FIG. 1 may achieve (or obtain) the same effect even when an inversion manner of the inversion driving method is changed between the image frame IF(n) and the next image frame IF(n+1) or even when a pattern difference is large between the image frame IF(n) and the next image frame IF(n+1).

Figure 4:
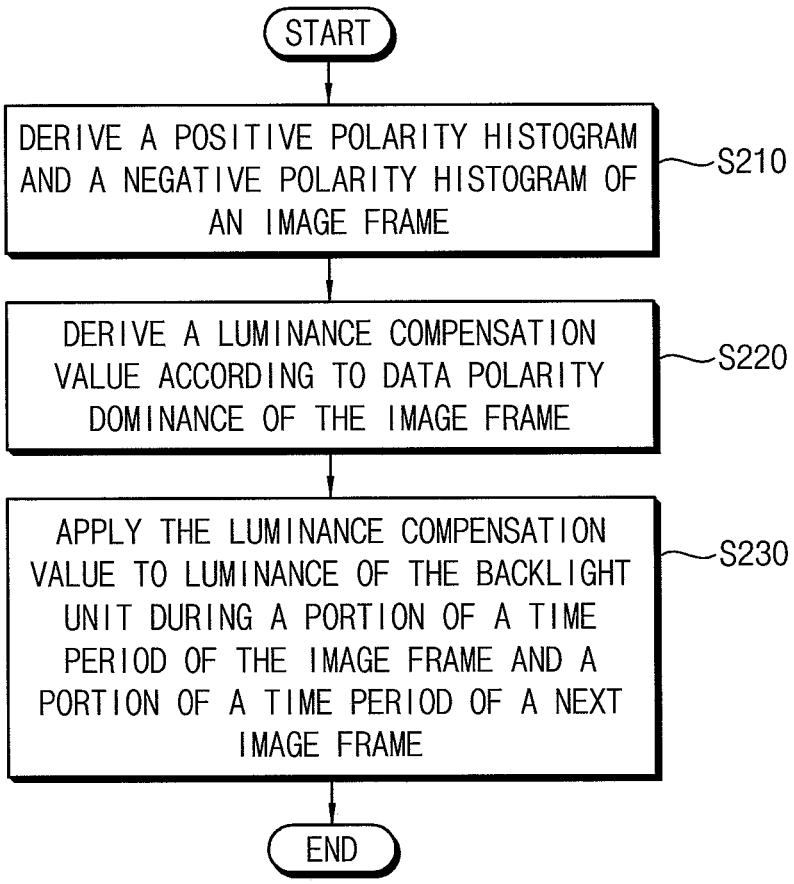
FIG. 4 is a flowchart illustrating a method of adjusting luminance of a backlight unit according to example embodiments.
Figure 5A:
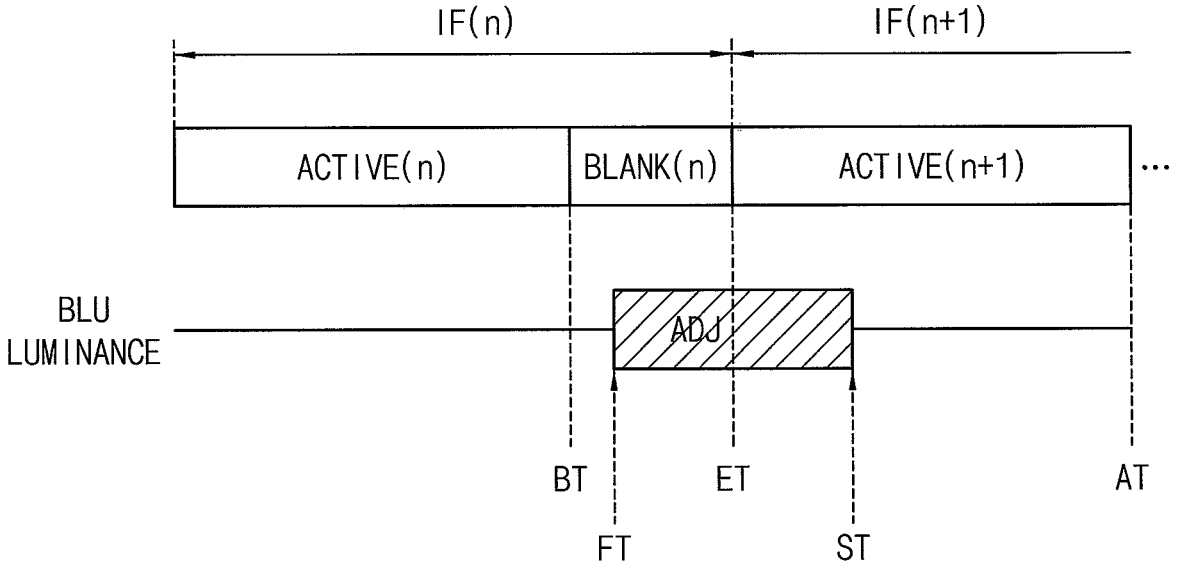
FIGS. 5A-5B are diagrams illustrating examples in which the method of FIG. 4 reflects a luminance compensation value on luminance of a backlight unit.
Figure 5B:
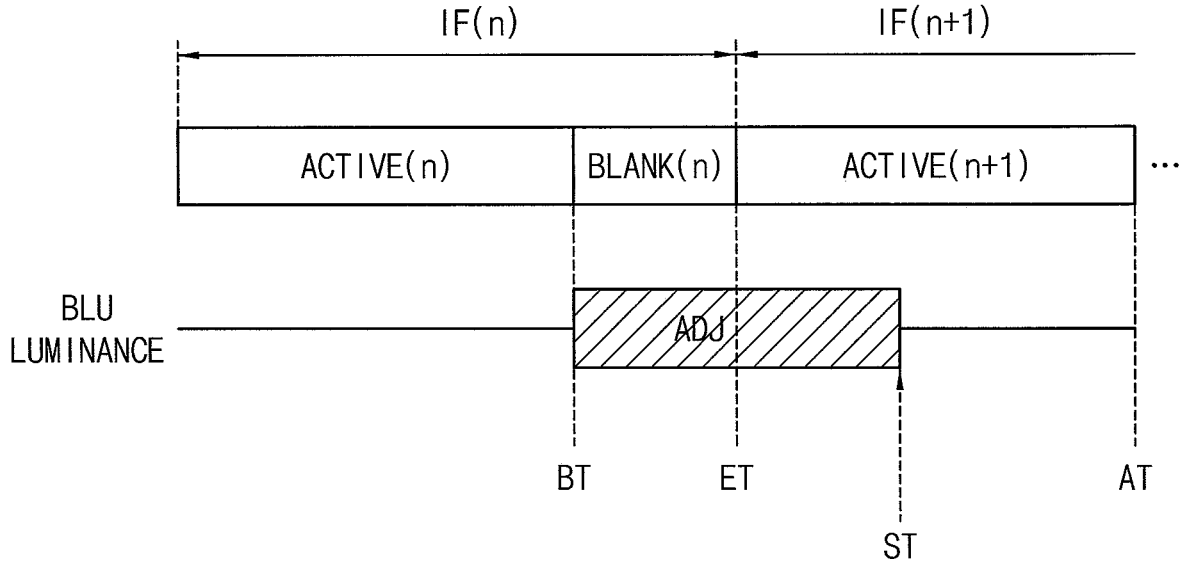

FIG. 4 is a flowchart illustrating a method of adjusting luminance of a backlight unit according to example embodiments, and FIGS. 5A-5B are diagrams illustrating examples in which the method of FIG. 4 reflects a luminance compensation value on luminance of a backlight unit.

Referring to FIGS. 4-5B, the method of FIG. 4 may adjust the luminance of the backlight unit included in the liquid crystal display device that performs an inversion driving method that repeatedly inverts data polarity for consecutive image frames IF(n) and IF(n+1) to have different data polarity patterns in order to reduce or prevent deterioration of a liquid crystal structure included in the liquid crystal display device. Here, the method of FIG. 4 may derive a positive polarity histogram and a negative polarity histogram of the image frame IF(n) based on image frame data, corresponding to the image frame IF(n), and a data polarity pattern for implementing the image frame IF(n) (S210). The method of FIG. 4 may derive a luminance compensation value according to data polarity dominance of the image frame IF(n) by analyzing the positive polarity histogram and the negative polarity histogram of the image frame IF(n) (S220). The method of FIG. 4 may also reflect the luminance compensation value according to the data polarity dominance of the image frame IF(n) on the luminance of the backlight unit during a portion of a time period of the image frame IF(n) and a portion of a time period of the next image frame IF(n+1) following the image frame IF(n) (S230). Because the acts S210 and S220 included in the method of FIG. 4 are substantially the same as the acts S110 and S120 included in the method of FIG. 1, the acts S210 and S220 included in the method of FIG. 4 will not be described below.

Specifically, the method of FIG. 4 may reflect (apply) the luminance compensation value according to the data polarity dominance of the image frame IF(n) on (to) the luminance of the backlight unit during the portion of the time period of the image frame IF(n) and the portion of the time period of the next image frame IF(n+1) (S230). In other words, except for the portion of the time period of the image frame IF(n), the method of FIG. 4 may maintain the luminance of the backlight unit as it is during the time period of the image frame IF(n). During the portion of the time period of the image frame IF(n) and the portion of the time period of the next image frame IF(n+1), the method of FIG. 4 may adjust the luminance of the backlight unit. In an example embodiment, as illustrated in FIG. 5A, the method of FIG. 4 may reflect the luminance compensation value according to the data polarity dominance of the image frame IF(n) on the luminance of the backlight unit from a first point FT that is after a start point BT of a blank period BLANK(n) of the image frame IF(n) to a second point ST that is before an end point AT of an active period ACTIVE(n+1) of the next image frame IF(n+1) (indicated by ADJ). In another example embodiment, as illustrated in FIG. 5B, the method of FIG. 4 may reflect the luminance compensation value according to the data polarity dominance of the image frame IF(n) on the luminance of the backlight unit from the start point BT of the blank period BLANK(n) of the image frame IF(n) to the second point ST that is before the end point AT of the active period ACTIVE(n+1) of the next image frame IF(n+1) (indicated by ADJ). In an example embodiment, when the method of FIG. 4 determines the luminance compensation value according to the data polarity dominance of the image frame IF(n), the method of FIG. 4 may apply a weighted value to the luminance compensation value differently according to the data polarity dominance of the image frame IF(n) for respective locations of a display panel included in the liquid crystal display device. In an example embodiment, the method of FIG. 4 may derive the luminance compensation value according to the data polarity dominance of the image frame IF(n) by searching a preset mapping table. Here, the data polarity dominance of the image frame IF(n) may be determined by comparing a sum of gray levels of positive polarity data with a sum of gray levels of negative polarity data.

As described above, the method of FIG. 4 may adjust the luminance of the backlight unit included in the liquid crystal display device that performs the inversion driving method that repeatedly inverts the data polarity for consecutive image frames IF(n) and IF(n+1) to have different data polarity patterns in order to reduce or prevent the deterioration of the liquid crystal structure. Here, the method of FIG. 4 may reduce or prevent the flicker that the viewer may perceive from among consecutive image frames IF(n) and IF(n+1) when the data polarity dominance of the image frame IF(n) is severe (i.e., when the positive polarity data is dominant based on gray levels or when the negative polarity data is dominant based on gray levels) by deriving the positive polarity histogram and the negative polarity histogram of the image frame IF(n) based on the image frame data, corresponding to the image frame IF(n), and the data polarity pattern for implementing the image frame IF(n) (S210), by deriving the luminance compensation value according to the data polarity dominance of the image frame IF(n) by analyzing the positive polarity histogram and the negative polarity histogram of the image frame IF(n) (S220), and by reflecting the luminance compensation value according to the data polarity dominance of the image frame IF(n) on the luminance of the backlight unit during the portion of the time period of the image frame IF(n) and the portion of the time period of the next image frame IF(n+1) (S230). Although the acts S210, S220, and S230 are described above with respect to the image frame IF(n), the acts S210, S220, and S230 may be performed in the same manner for the next image frame IF(n+1). However, because the data polarity pattern of the image frame IF(n) is different from that of the next image frame IF(n+1) as the liquid crystal display device performs the inversion driving method, the luminance compensation value according the data polarity dominance of the image frame IF(n) may be different from that of the next image frame IF(n+1) even when the same image frame data is applied for the image frame IF(n) and the next image frame IF(n+1). Furthermore, because the method of FIG. 4 applies an analysis result of the image frame IF(n) to the image frame IF(n), the method of FIG. 4 may achieve the same effect even when an inversion manner of the inversion driving method is changed between the image frame IF(n) and the next image frame IF(n+1) or even when a pattern difference is large between the image frame IF(n) and the next image frame IF(n+1).

Figure 6:
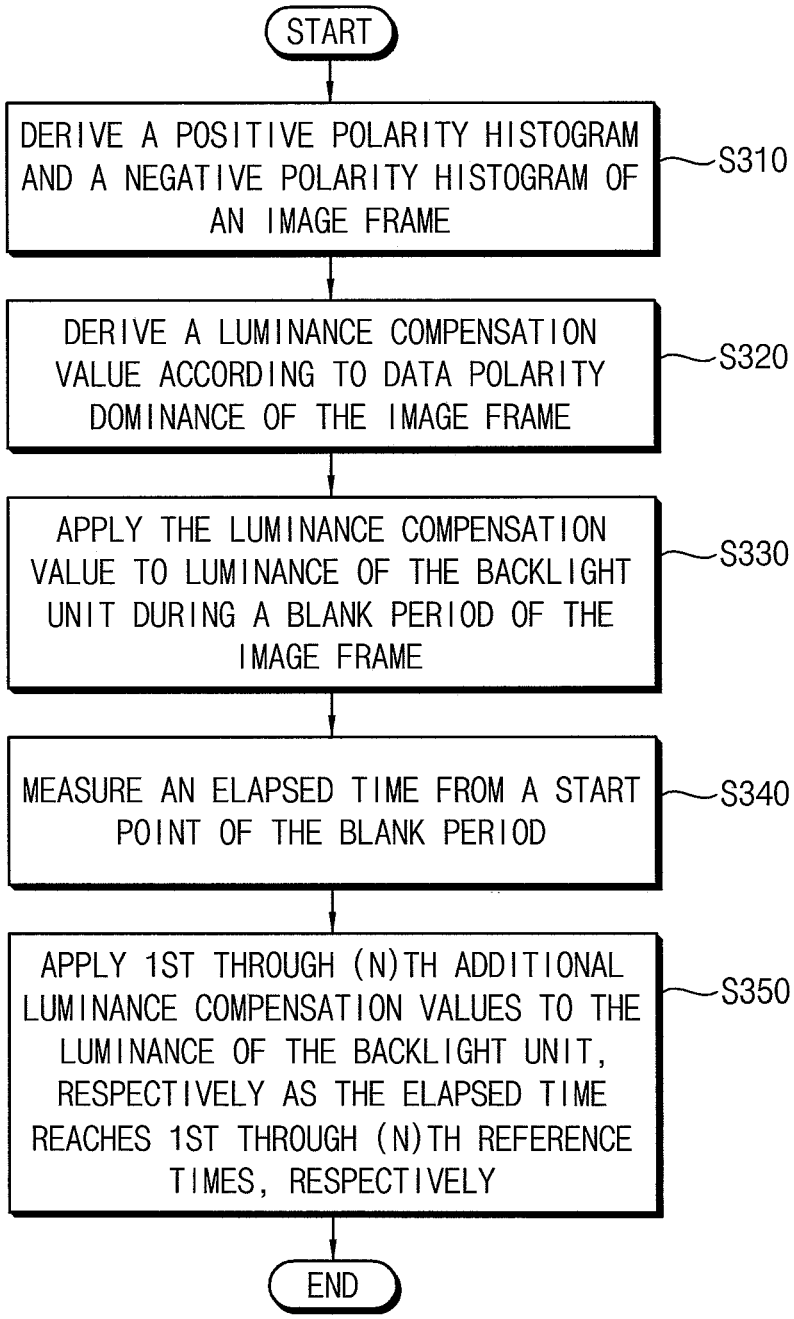
FIG. 6 is a flowchart illustrating a method of adjusting luminance of a backlight unit according to example embodiments.
Figure 7:
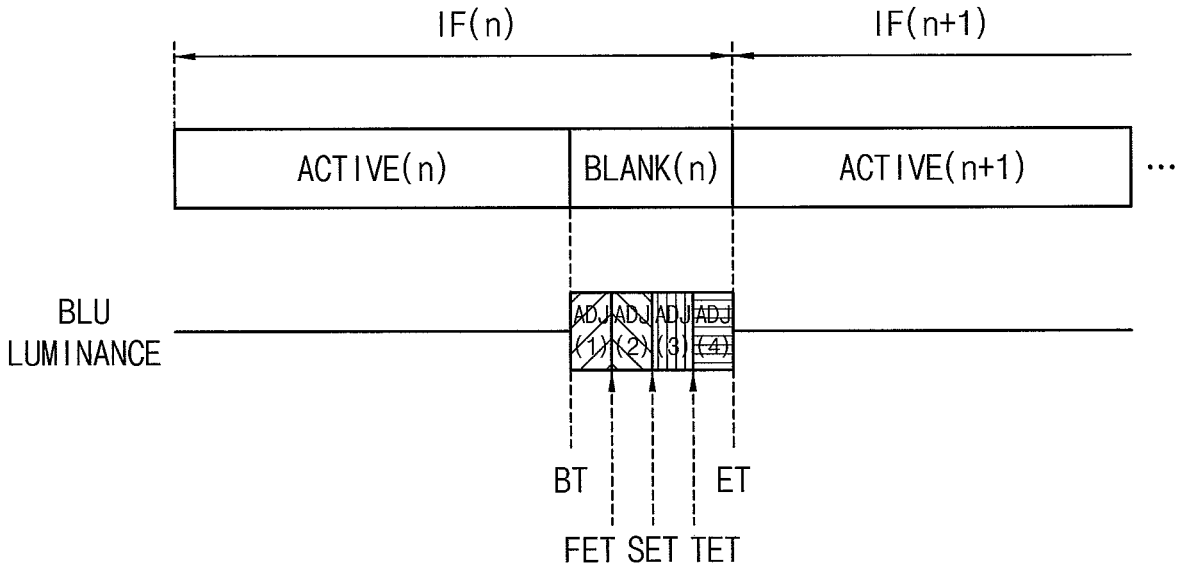
FIG. 7 is a diagram illustrating an example in which the method of FIG. 6 reflects a luminance compensation value and an additional luminance compensation value on luminance of a backlight unit.

FIG. 6 is a flowchart illustrating a method of adjusting luminance of a backlight unit according to example embodiments, and FIG. 7 is a diagram illustrating an example in which the method of FIG. 6 reflects a luminance compensation value and an additional luminance compensation value on luminance of a backlight unit.

Referring to FIGS. 6-7, the method of FIG. 6 may adjust the luminance of the backlight unit included in the liquid crystal display device that performs an inversion driving method that repeatedly inverts data polarity for consecutive image frames IF(n) and IF(n+1) to have different data polarity patterns in order to reduce or prevent deterioration of a liquid crystal structure included in the liquid crystal display device. Here, the method of FIG. 6 may derive a positive polarity histogram and a negative polarity histogram of the image frame IF(n) based on image frame data, corresponding to the image frame IF(n), and a data polarity pattern for implementing the image frame IF(n) (S310). The method of FIG. 6 may derive a luminance compensation value according to data polarity dominance of the image frame IF(n) by analyzing the positive polarity histogram and the negative polarity histogram of the image frame IF(n) (S320). The method of FIG. 6 may also reflect the luminance compensation value according to the data polarity dominance of the image frame IF(n) on the luminance of the backlight unit from a start point BT of a blank period BLANK(n) of the image frame IF(n) to an end point ET of the blank period BLANK(n) of the image frame IF(n) (S330). The method of FIG. 6 may measure an elapsed time from the start point BT of the blank period BLANK(n) of the image frame IF(n) (S340). The method of FIG. 6 may also reflect first through (N)th additional luminance compensation values on the luminance of the backlight unit, respectively as the elapsed time reaches first through (N)th reference times FET, SET, and TET through NET, respectively (S350). Because the acts S310 and S320 included in the method of FIG. 6 are substantially the same as the acts S110 and S120 included in the method of FIG. 1, the acts S310 and S320 included in the method of FIG. 6 will not be described below.

Specifically, the method of FIG. 6 may reflect (apply) the luminance compensation value according to the data polarity dominance of the image frame IF(n) on (to) the luminance of the backlight unit from the start point BT of the blank period BLANK(n) of the image frame IF(n) to the end point ET of the blank period BLANK(n) of the image frame IF(n) (S330). In other words, the method of FIG. 6 may maintain the luminance of the backlight unit as it is during an active period ACTIVE(n) of the image frame IF(n) and may adjust the luminance of the backlight unit only during the blank period BLANK(n) of the image frame IF(n). In an example embodiment, when the method of FIG. 6 determines the luminance compensation value according to the data polarity dominance of the image frame IF(n), the method of FIG. 6 may apply a weighted value to the luminance compensation value differently according to the data polarity dominance of the image frame IF(n) for respective locations of a display panel included in the liquid crystal display device. In an example embodiment, the method of FIG. 6 may derive the luminance compensation value according to the data polarity dominance of the image frame IF(n) by searching a preset mapping table. Here, the data polarity dominance of the image frame IF(n) may be determined by comparing a sum of gray levels of positive polarity data with a sum of gray levels of negative polarity data. Subsequently, the method of FIG. 6 may measure the elapsed time from the start point BT of the blank period BLANK(n) of the image frame IF(n) (S340) and may reflect the first through (N)th additional luminance compensation values on the luminance of the backlight unit, respectively as the elapsed time reaches the first through (N)th reference times FET, SET, and TET through NET, respectively (S350). In an example embodiment, the method of FIG. 6 may measure the elapsed time by counting data enable clocks or oscillator reference clocks. Generally, as a driving frequency of the liquid crystal display device varies (e.g., a mode is changed between a normal mode and a power consumption reduction mode, a panel self refresh (PSR) function is performed, etc), the blank period BLANK(n) of the image frame IF(n) may also vary. Here, when a time (or length) of the blank period BLANK(n) of the image frame IF(n) is increased, the driving frequency of the liquid crystal display device may be decreased. On the other hand, when the time of the blank period BLANK(n) of the image frame IF(n) is decreased, the driving frequency of the liquid crystal display device may be increased. Thus, the method of FIG. 6 may reduce or prevent a flicker that occurs when the liquid crystal display device operates at a low driving frequency by deriving the driving frequency by measuring the elapsed time from the start point BT of the blank period BLANK(n) of the image frame IF(n) and by reflecting the first through (N)th additional luminance compensation values on the luminance of the backlight unit, respectively as the elapsed time reaches the first through (N)th reference times FET, SET, and TET through NET, respectively.

For example, as illustrated in FIG. 7, when the elapsed time from the start point BT of the blank period BLANK(n) of the image frame IF(n) has not reach the first reference time FET, the method of FIG. 6 may reflect the luminance compensation value according to the data polarity dominance of the image frame IF(n) on the luminance of the backlight unit (indicated by ADJ(1)). Next, when the elapsed time from the start point BT of the blank period BLANK(n) of the image frame IF(n) reaches the first reference time FET and when the elapsed time from the start point BT of the blank period BLANK(n) of the image frame IF(n) has not reach the second reference time SET, the method of FIG. 6 may additionally reflect the first additional luminance compensation value on the luminance of the backlight unit while reflecting the luminance compensation value according to the data polarity dominance of the image frame IF(n) on the luminance of the backlight unit (indicated by ADJ(2)). Subsequently, when the elapsed time from the start point BT of the blank period BLANK(n) of the image frame IF(n) reaches the second reference time SET and when the elapsed time from the start point BT of the blank period BLANK(n) of the image frame IF(n) has not reach the third reference time TET, the method of FIG. 6 may additionally reflect the second additional luminance compensation value on the luminance of the backlight unit while reflecting the luminance compensation value according to the data polarity dominance of the image frame IF(n) on the luminance of the backlight unit (indicated by ADJ(3)). Next, when the elapsed time from the start point BT of the blank period BLANK(n) of the image frame IF(n) reaches the third reference time TET, the method of FIG. 6 may additionally reflect the third additional luminance compensation value on the luminance of the backlight unit while reflecting the luminance compensation value according to the data polarity dominance of the image frame IF(n) on the luminance of the backlight unit (indicated by ADJ(4)). Although the first through third reference times FET, SET, and TET (N is 3) are described in FIG. 7, the first through (N)th reference times are not limited thereto.

As described above, the method of FIG. 6 may adjust the luminance of the backlight unit included in the liquid crystal display device that performs the inversion driving method that repeatedly inverts the data polarity for consecutive image frames IF(n) and IF(n+1) to have different data polarity patterns in order to reduce or prevent the deterioration of the liquid crystal structure. Here, the method of FIG. 6 may reduce or prevent the flicker that the viewer may perceive from among consecutive image frames IF(n) and IF(n+1) when the data polarity dominance of the image frame IF(n) is severe (i.e., when the positive polarity data is dominant based on gray levels or when the negative polarity data is dominant based on gray levels) by deriving the positive polarity histogram and the negative polarity histogram of the image frame IF(n) based on the image frame data, corresponding to the image frame IF(n), and the data polarity pattern for implementing the image frame IF(n) (S310), by deriving the luminance compensation value according to the data polarity dominance of the image frame IF(n) by analyzing the positive polarity histogram and the negative polarity histogram of the image frame IF(n) (S320), and by reflecting the luminance compensation value according to the data polarity dominance of the image frame IF(n) on the luminance of the backlight unit during the blank period BLANK(n) of the image frame IF(n) (S330). In addition, the method of FIG. 6 may reduce or prevent the low frequency flicker that occurs when the liquid crystal display device operates at a low driving frequency by measuring the elapsed time from the start point BT of the blank period BLANK(n) of the image frame IF(n) (S340) and by reflecting the first through (N)th additional luminance compensation values on the luminance of the backlight unit, respectively (sequentially) as the elapsed time reaches the first through (N)th reference times (the corresponding first through (N)th reference times) FET, SET, and TET through NET, respectively (S350). Although the acts S310, S320, S330, S340, and S350 are described above with respect to the image frame IF(n), the acts S310, S320, S330, S340, and S350 may be performed in the same manner for the next image frame IF(n+1). However, because the data polarity pattern of the image frame IF(n) is different from that of the next image frame IF(n+1) as the liquid crystal display device performs the inversion driving method, the luminance compensation value according the data polarity dominance of the image frame IF(n) may be different from that of the next image frame IF(n+1) even when the same image frame data is applied for the image frame IF(n) and the next image frame IF(n+1). Furthermore, because the method of FIG. 6 applies an analysis result of the image frame IF(n) to the image frame IF(n), the method of FIG. 6 may achieve the same effect even when an inversion manner of the inversion driving method is changed between the image frame IF(n) and the next image frame IF(n+1) or even when a pattern difference is large between the image frame IF(n) and the next image frame IF(n+1).

Figure 8:
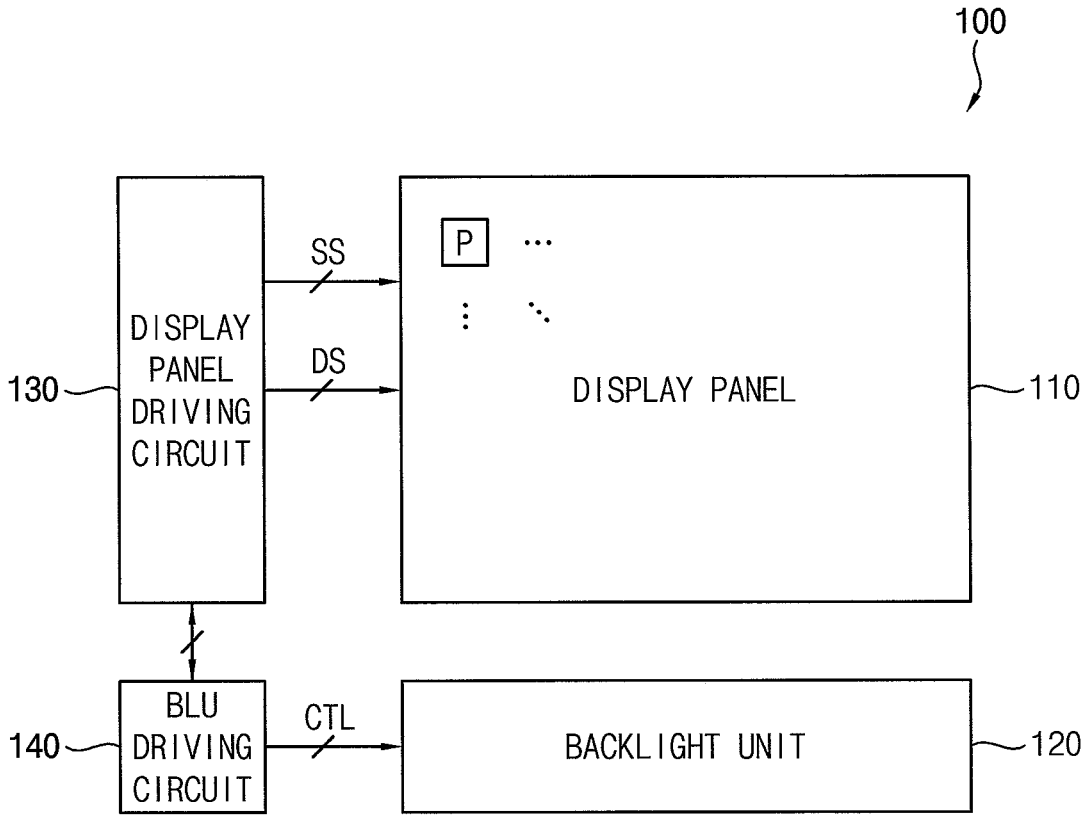
FIG. 8 is a block diagram illustrating a liquid crystal display device according to example embodiments.

FIG. 8 is a block diagram illustrating a liquid crystal display device according to example embodiments.

Referring to FIG. 8, the liquid crystal display device 100 may include a display panel 110, a backlight unit 120, a display panel driving circuit 130, and a backlight unit driving circuit 140. Here, the liquid crystal display device 100 may perform an inversion driving method that repeatedly inverts data polarity for consecutive image frames to have different data polarity patterns in order to reduce or prevent deterioration of a liquid crystal structure.

The display panel 110 may include a plurality of pixels P. Each of the pixels P may include a transistor, a capacitor, a liquid crystal structure, etc. Each of the pixels P may implement (or display) a gray level based on transmittance of the liquid crystal structure. The pixels P may be arranged with each other in various suitable manners (e.g., a matrix manner, etc) in the display panel 110. The display panel driving circuit 130 may drive the display panel 110. In an example embodiment, the display panel driving circuit 130 may include a scan driver, a data driver, a timing controller, etc. The display panel 110 may be connected to the data driver via a plurality of data-lines. The display panel 110 may be connected to the scan driver via a plurality of scan-lines. The data driver may provide a data signal DS to the pixels P of the display panel 110 via the data-lines. The scan driver may provide a scan signal SS to the pixels P of the display panel 110 via the scan-lines. The timing controller may generate a control signal and may provide the control signal to the scan driver and the data driver to control the scan driver and the data driver. In some example embodiments, the timing controller may perform a specific processing (e.g., data compensation, etc) on image frame data input from an external component. The backlight unit 120 may be disposed under the display panel 110 or beside the display panel 110 to provide light to the display panel 110. The backlight unit driving circuit 140 may drive the backlight unit 120 (indicated by CTL).

Specifically, the backlight unit driving circuit 140 may reduce or prevent a flicker that occurs when data polarity dominance of an image frame is severe while the liquid crystal display device 100 performs the inversion driving method. In an example embodiment, the backlight unit driving circuit 140 may derive a positive polarity histogram and a negative polarity histogram of the image frame based on image frame data, corresponding to the image frame, and a data polarity pattern for implementing the image frame. The backlight unit driving circuit 140 may derive a luminance compensation value according to the data polarity dominance of the image frame by analyzing the positive polarity histogram and the negative polarity histogram of the image frame, and may reflect the luminance compensation value according to the data polarity dominance of the image frame on luminance of the backlight unit during a portion of a time period of the image frame. In another example embodiment, the backlight unit driving circuit 140 may derive a positive polarity histogram and a negative polarity histogram of the image frame based on image frame data, corresponding to the image frame, and a data polarity pattern for implementing the image frame. The backlight unit driving circuit 140 may derive a luminance compensation value according to the data polarity dominance of the image frame by analyzing the positive polarity histogram and the negative polarity histogram of the image frame, and may reflect the luminance compensation value according to the data polarity dominance of the image frame on luminance of the backlight unit during a portion of a time period of the image frame and a portion of a time period of a next image frame following the image frame. In still another example embodiment, the backlight unit driving circuit 140 may derive a positive polarity histogram and a negative polarity histogram of the image frame based on image frame data, corresponding to the image frame, and a data polarity pattern for implementing the image frame. The backlight unit driving circuit 140 may derive a luminance compensation value according to the data polarity dominance of the image frame by analyzing the positive polarity histogram and the negative polarity histogram of the image frame. The backlight unit driving circuit 140 may reflect the luminance compensation value according to the data polarity dominance of the image frame on luminance of the backlight unit from a start point of a blank period of the image frame to an end point of the blank period of the image frame. The backlight unit driving circuit 140 may measure an elapsed time from the start point of the blank period of the image frame, and may reflect first through (N)th additional luminance compensation values on the luminance of the backlight unit, respectively as the elapsed time reaches first through (N)th reference times, respectively. Because these embodiments are described above with reference to FIGS. 1-7, duplicated description related thereto will not be repeated. Although FIG. 8 illustrates the backlight unit driving circuit 140 as separate from the display panel driving circuit 130, in some example embodiments, the backlight unit driving circuit 140 and the display panel driving circuit 130 may be merged. For example, the backlight unit driving circuit 140 may be included in the display panel driving circuit 130.

Figure 9:
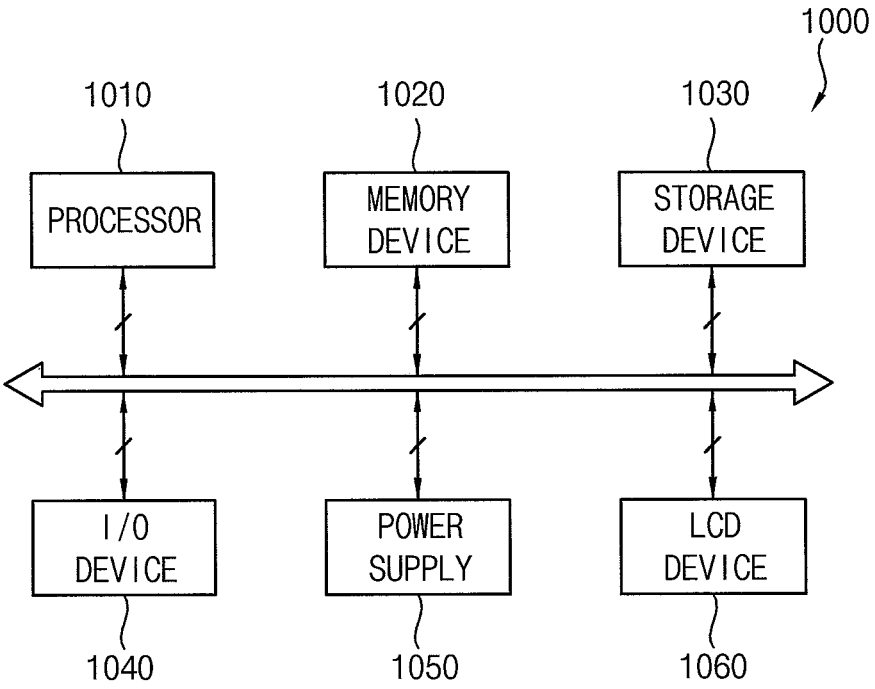
FIG. 9 is a block diagram illustrating an electronic device according to example embodiments.
Figure 10:
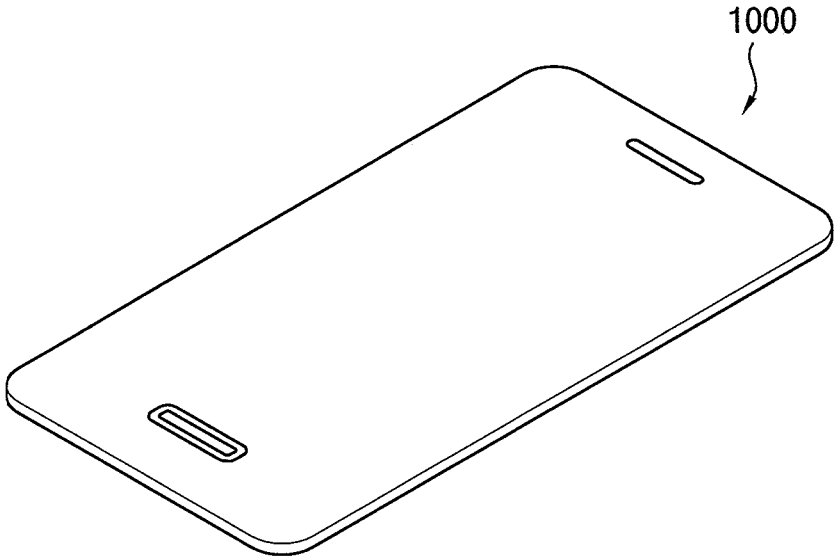
FIG. 10 is a diagram illustrating an example in which the electronic device of FIG. 9 is implemented as a smart phone.

FIG. 9 is a block diagram illustrating an electronic device according to example embodiments, and FIG. 10 is a diagram illustrating an example in which the electronic device of FIG. 9 is implemented as a smart phone.

Referring to FIGS. 9-10, the electronic device 1000 may include a processor 1010, a memory device 1020, a storage device 1030, an input/output (I/O) device 1040, a power supply 1050, and a liquid crystal display device 1060. Here, the liquid crystal display device 1060 may be the liquid crystal display device 100 of FIG. 8. In addition, the electronic device 1000 may further include a plurality of ports for communicating with a video card, a sound card, a memory card, a universal serial bus (USB) device, other electronic devices, etc. . . . In an example embodiment, as illustrated in FIG. 10, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, etc. . . .

The processor 1010 may perform various suitable computing functions. The processor 1010 may be a micro processor, a central processing unit (CPU), an application processor (AP), etc. . . . The processor 1010 may be coupled to other components via an address bus, a control bus, a data bus, etc. . . . Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc and/or at least one volatile memory device such as a dynamic random access memory (DRAM) device, a static random access memory (SRAM) device, a mobile DRAM device, etc. . . . The storage device 1030 may include a solid state drive (SSD) device, a hard disk drive (HDD) device, a CD-ROM device, etc. . . . The I/O device 1040 may include an input device such as a keyboard, a keypad, a mouse device, a touch-pad, a touch-screen, etc, and an output device such as a printer, a speaker, etc. . . . The power supply 1050 may provide power for operations of the electronic device 1000.

The liquid crystal display device 1060 may be coupled to other components via the buses or other communication links. In some example embodiments, the liquid crystal display device 1060 may be included in the I/O device 1040. As described above, the liquid crystal display device 1060 may perform an inversion driving method that repeatedly inverts data polarity for consecutive image frames to have different data polarity patterns to reduce or prevent deterioration of a liquid crystal structure included in the liquid crystal display device 1060. Here, the liquid crystal display device 1060 may reduce or prevent a flicker that a viewer may perceive from among consecutive image frames when data polarity dominance of the image frame is severe (i.e., when positive polarity data is dominant based on gray levels or when negative polarity data is dominant based on gray levels) by deriving a positive polarity histogram and a negative polarity histogram of the image frame based on image frame data, corresponding to the image frame, and a data polarity pattern for implementing the image frame, by deriving a luminance compensation value according to the data polarity dominance of the image frame by analyzing the positive polarity histogram and the negative polarity histogram of the image frame, and by reflecting the luminance compensation value according to the data polarity dominance of the image frame on luminance of a backlight unit during a portion of a time period of the image frame (or during a portion of a time period of the image frame and a portion of a time period of a next image frame). In addition, the liquid crystal display device 1060 may reduce or prevent a low frequency flicker that occurs when the liquid crystal display device 1060 operates at a low driving frequency by measuring an elapsed time from a start point of a blank period of the image frame and by reflecting first through (N)th additional luminance compensation values on the luminance of the backlight unit, respectively as the elapsed time reaches first through (N)th reference times, respectively. Because these are described above, duplicated description related thereto will not be repeated.

The present inventive concept may be applied to a liquid crystal display device and an electronic device including the liquid crystal display device. For example, the present inventive concept may be applied to a cellular phone, a smart phone, a video phone, a smart pad, a smart watch, a tablet PC, a car navigation system, a television, a computer monitor, a laptop, an MP3 player, etc. . . .

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept."

As used herein, the term "substantially," "about," and similar terms are used as terms of approximation and not as terms of degree, and are intended to account for the inherent deviations in measured or calculated values that would be recognized by those of ordinary skill in the art.

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

It will be understood that when an element or layer is referred to as being "on", "connected to", or "coupled to" another element or layer, it can be directly on, connected to, or coupled to the other element or layer, or one or more intervening elements or layers may be present. In contrast, when an element or layer is referred to as being "directly on," "directly connected to", or "directly coupled to" another element or layer, there are no intervening elements or layers present.

The display devices and/or any other relevant devices or components according to embodiments of the present disclosure described herein, such as, for example, a timing controller, a data driver, and a gate driver, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of ordinary skill in the art should recognize that the functionality of various computing/electronic devices may be combined or integrated into a single computing/electronic device, or the functionality of a particular computing/electronic device may be distributed across one or more other computing/electronic devices without departing from the spirit and scope of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. A method of adjusting luminance of a backlight unit included in a liquid crystal display device that performs inversion driving, the method comprising:

deriving a positive polarity histogram and a negative polarity histogram of an image frame based on image frame data, corresponding to the image frame, and a data polarity pattern for implementing the image frame;

deriving a luminance compensation value according to data polarity dominance of the image frame by analyzing the positive polarity histogram and the negative polarity histogram; and applying the luminance compensation value to the luminance of the backlight unit during a portion of a time period of the image frame.

2. The method of claim 1, wherein the portion of the time period of the image frame substantially begins at a start point of a blank period of the image frame and substantially ends at an end point of the blank period of the image frame.

3. The method of claim 1, wherein the portion of the time period of the image frame substantially begins at a first point which is after a start point of a blank period of the image frame and substantially ends at an end point of the blank period of the image frame.

4. The method of claim 1, wherein the portion of the time period of the image frame substantially begins at a start point of a blank period of the image frame and substantially ends at a second point which is before an end point of the blank period of the image frame.

5. The method of claim 1, wherein the portion of the time period of the image frame substantially begins at a first point which is after a start point of a blank period of the image frame and substantially ends at a second point which is before an end point of the blank period of the image frame.

6. The method of claim 1, wherein a weighted value is applied to the luminance compensation value differently for respective locations of a display panel included in the liquid crystal display device.

7. The method of claim 1, wherein the luminance compensation value according to the data polarity dominance is derived by searching a preset mapping table.

8. The method of claim 7, wherein the data polarity dominance is determined by comparing a sum of gray levels of positive polarity data with a sum of gray levels of negative polarity data.

9. A method of adjusting luminance of a backlight unit included in a liquid crystal display device that performs inversion driving, the method comprising:

deriving a positive polarity histogram and a negative polarity histogram of an image frame based on image frame data, corresponding to the image frame, and a data polarity pattern for implementing the image frame;

deriving a luminance compensation value according to data polarity dominance of the image frame by analyzing the positive polarity histogram and the negative polarity histogram;

applying the luminance compensation value to the luminance of the backlight unit from a start point of a blank period of the image frame to an end point of the blank period of the image frame;

measuring an elapsed time from the start point of the blank period of the image frame; and applying first through (N)th additional luminance compensation values, where N is an integer greater than or equal to 1, to the luminance of the backlight unit, sequentially as the elapsed time reaches corresponding first through (N)th reference times.

10. The method of claim 9, wherein the elapsed time is measured by counting data enable clocks or oscillator reference clocks.

11. The method of claim 9, wherein a weighted value is applied to the luminance compensation value and the first through (N)th additional luminance compensation values differently for respective locations of a display panel included in the liquid crystal display device.

12. The method of claim 9, wherein the luminance compensation value according to the data polarity dominance is derived by searching a preset mapping table.

13. The method of claim 12, wherein the data polarity dominance is determined by comparing a sum of gray levels of positive polarity data with a sum of gray levels of negative polarity data.

14. A method of adjusting luminance of a backlight unit included in a liquid crystal display device that performs inversion driving, the method comprising:

deriving a positive polarity histogram and a negative polarity histogram of an image frame based on image frame data, corresponding to the image frame, and a data polarity pattern for implementing the image frame;

deriving a luminance compensation value according to data polarity dominance of the image frame by analyzing the positive polarity histogram and the negative polarity histogram; and applying the luminance compensation value to the luminance of the backlight unit during a portion of a time period of the image frame and a portion of a time period of a next image frame following the image frame.

15. The method of claim 14, wherein the portion of the time period of the image frame substantially begins at a start point of a blank period of the image frame and substantially ends at an end point of the blank period of the image frame.

16. The method of claim 14, wherein the portion of the time period of the image frame substantially begins at a first point which is after a start point of a blank period of the image frame and substantially ends at an end point of the blank period of the image frame.

17. The method of claim 14, wherein the portion of the time period of the next image frame substantially begins at a start point of an active period of the next image frame and substantially ends at a second point which is before an end point of the active period of the next image frame.

18. The method of claim 14, wherein a weighted value is applied to the luminance compensation value differently for respective locations of a display panel included in the liquid crystal display device.

19. The method of claim 14, wherein the luminance compensation value according to the data polarity dominance is derived by searching a preset mapping table.

20. The method of claim 19, wherein the data polarity dominance is determined by comparing a sum of gray levels of positive polarity data with a sum of gray levels of negative polarity data.

* * * * *